United States Patent [19]

Thring

[11] Patent Number: 5,050,570

[45] Date of Patent: Sep. 24, 1991

[54] OPEN CYCLE, INTERNAL COMBUSTION STIRLING ENGINE

[76] Inventor: Robert H. Thring, Rte. 1, Box 241C, Devine, Tex. 78016

[21] Appl. No.: 333,326

[22] Filed: Apr. 5, 1989

[51] Int. Cl.[5] ..... F02G 5/00; F02B 33/10

[52] U.S. Cl. ..... 123/556; 123/71 R; 123/72

[58] Field of Search ..... 60/517, 526; 123/543, 123/556, 71 R

[56] References Cited

U.S. PATENT DOCUMENTS

| | | | |
|---|---|---|---|
| 2,897,801 | 8/1959 | Kloss | 123/556 X |
| 2,938,506 | 5/1960 | Buchi | 123/74 AE |
| 3,872,839 | 3/1975 | Russell et al. | 123/556 X |
| 4,185,597 | 1/1980 | Cinquegrani | 123/71 R |
| 4,284,055 | 8/1981 | Wakeman | 123/556 |
| 4,564,425 | 1/1986 | Petrzilka et al. | 350/350 R |
| 4,621,901 | 11/1986 | Petrzilka et al. | 350/350 R |
| 4,670,182 | 6/1987 | Fujita et al. | 252/299.61 |
| 4,676,604 | 6/1957 | Petrzilka | 350/350 R |
| 4,770,503 | 9/1988 | Buchecker et al. | 350/350 R |
| 4,776,975 | 10/1988 | Sawada et al. | 252/299.61 |
| 4,778,620 | 10/1988 | Goto et al. | 252/299.63 |
| 4,790,284 | 12/1988 | Ferrenberg | 123/543 |
| 4,815,825 | 5/1989 | Nakagomi et al. | 252/299.5 |
| 4,820,878 | 4/1989 | Takatsu et al. | 252/299.63 |
| 4,846,999 | 7/1989 | Kizaki | 252/299.63 |

FOREIGN PATENT DOCUMENTS 8802130 3/1988 World Int. Prop. O. .

*Primary Examiner*—Allen M. Ostrager
*Attorney, Agent, or Firm*—Cox and Smith Incorporated

[57] ABSTRACT

An open-cycle internal-combustion Stirling engine having two pistons coupled by a rhombic drive which define a combustion chamber and a compression chamber, within either a single cylinder or two cylinders, and a manifold enabling flow of the working fluid between the compression chamber and the combustion chamber with a plurality of engine valves controlling such flow, the dead space of the manifold being minimized and provision of the working fluid (i.e., air) being provided by an intake valve and an exhaust valve with corresponding manifolds for providing the open-cycle characteristics of the engine while approximating an ideal thermo-dynamic system.

19 Claims, 3 Drawing Sheets

OPEN CYCLE, INTERNAL COMBUSTION STIRLING ENGINE

BACKGROUND OF THE INVENTION

The present invention relates to an open cycle, internal combustion, Stirling engine. More particularly, the present invention relates to an open cycle, internal combustion, Stirling engine of improved operating characteristics enabled by the combination of various means including specially configured manifolds and various valve mechanisms for controlling the flow of the air or other working fluid.

The Stirling or "hot gas" engine is a type of engine long known in the art. Although greatly overshadowed in commercial use by engines using the Otto or Diesel cycles, the Stirling engine has long been the subject of study because of several practical and theoretical advantages it has over more common engines.

The Stirling engine bases its design in an attempt to simulate the Stirling thermodynamic cycle. The Stirling cycle is, in theory, a cycle comprising constant volume and constant temperature processes which has theoretical efficiencies much higher than those found in the Otto or Diesel cycles. However, the Stirling cycle has had difficulty in finding practical applications because of design barriers in manufacturing an engine capable of efficiently and quickly performing the constant volume and constant temperature steps in the cycle. For a more elaborate history of the Stirling engine, see; Walker, *Stirling Engines*, Oxford University Press (1980) which is incorporated herein in its entirety for all purposes.

Among the various alternatives for Stirling engine designs, most designs employ "external" combustion, typically in a closed cycle engine, as shown in U.S. Pat. Nos. 3,442,079 and 3,399,526. The combustion is labeled "external" because the combustion occurs outside or separate from the working fluid and the heat generated is transferred to the working fluid. This differs from the more common internal combustion engine where the working fluid (i.e., air) is mixed with fuel and ignited.

External combustion, closed cycle Stirling engines have a number of practical and technical drawbacks. First, the working fluid normally chosen for a closed cycle engine is hydrogen or helium instead of air because of the higher power density and higher thermal efficiency offered by those substances compared to air. However, the use of hydrogen or helium at pressures above 100 bar may produce significant problems. For instance, safety hazards from explosions are present when hydrogen gas is used, especially under high pressure. Also, limitations exist in the selection of materials, particularly seals and rings, which can function under these conditions, because it is necessary to store the working fluid without allowing it to escape outside of the engine.

Further, because Stirling engines typically operate on a closed cycle, the heat transfer which must occur during the constant temperature steps is normally required to occur through an impermeable wall so that the enclosed working fluid does not escape. The drawback to this design requirement is that efficient and rapid heat transfer through the impermeable wall may normally be gained only by using large surface areas in the wall, which increases weight and expense, and reduces efficiency. The amount of heat transferred through the wall is represented by:

$$Q = A \times h \times \Delta T$$

Where A is the surface area of the wall, h is the overall heat transfer coefficient of the wall, $\Delta$ T is the temperature difference between the opposite surfaces of the wall and Q is the heat transferred. Because Q and h are relatively fixed in an engine (the choice of materials typically being limited by economic considerations), an increase in the surface area A implies a lower temperature difference $\Delta$ T, which increases efficiency. However, increased surface area A creates excessive dead volume in the engine, which decreases efficiency. As a result, closed cycle Stirling engines tend to have higher dead volumes than are desirable.

An open cycle, internal combustion Stirling engine would avoid many of the problems of a closed cycle, external combustion Stirling engine. First, the working fluid of an internal combustion engine (normally air) is stable when compared to hydrogen. Also, air is freely available, which minimizes the sealing and storage problems. Other advantages in engines of that design, such as faster start up time and more rapid acceleration capability, have been recognized in U.S. Pat. No. 4,004,421, issued to Cowans. As far as known, that patent appears to be one of the first disclosures of a design for an internal combustion, open cycle Stirling engine.

However, the engine disclosed in Cowans is believed to be unduly complex and appears costly to produce. Cowans discloses a compressor-expander system connected to an additional regenerator for intake and exhaust of the working fluid. The compressor-expander system pressurizes and depressurizes the working fluid before introducing it into the hot and cold chambers, thus raising the mean effective pressure in the cylinder. The Cowans design would, therefore, more properly be described as a "semi-closed" cycle engine rather than as an "open cycle engine". Obviously, the compressor-expander system adds expense to the cost of manufacture and reduces power output from the engine because of the power needs of the compressor-expander system. Other U.S. Patents which may relate to the present invention are U.S. Pat. No. 3,638,420, issued to Kelly et al; U.S. Pat. No. 2,951,334, issued to Meijer; and U.S. Pat. No. 3,180,078, issued to Liston. Each of those patents discloses a particular closed-cycle Stirling engine in combination with various heat transferring means and relative configurations of pistons. Although not referring to open-cycle, internal combustion Stirling engines, other internal combustion engines are disclosed in the following U.S. Patents and may have preceded the present invention: U.S. Pat. No. 4,344,405 issued to Zaharis; U.S. Pat. No. 1,372,216 issued to Casaday; U.S. Pat. No. 1,512,573 issued to Breguet; U.S. Pat. No. 3,177,856 issued to Perkins; U.S. Pat. No. 2,091,410 issued to Mallory; U.S. Pat. No. 4,114,567 issued to Burton; and U.S. Pat. No. 4,011,839 issued to Pfefferle.

The present invention improves on Stirling cycle engines known in the prior art in many ways, including by the employment of an intake and exhaust system controlled and enhanced by standard engine valves. The present invention also does not require a complex, costly compressor-expander system and therefore greatly simplifies the design and operation of the engine. Many other advantages and improvements of the present invention will be evident from the following descriptions.

Therefore, it is an object of the present invention to provide an improved open cycle, internal combustion Stirling engine. It is also an object of the present invention to provide an improved open cycle, internal combustion Stirling engine which is simple in design and efficient in operation.

These and other objects, features and advantages of the invention will become evident in light of the following detailed description, viewed in conjunction with the referenced drawings and appended claims, of an open cycle, internal combustion Stirling engine according to the invention. The foregoing and following description of the invention is for exemplary purposes only.

SUMMARY OF THE INVENTION

The present invention provides for an open cycle, internal combustion Stirling engine which comprises a cylinder forming a combustion chamber at one end thereof, two piston means slidably mounted within said cylinder, and means for driving said piston means in a manner which accomplishes the aforesaid objects and others. The first of said piston means is disposed within said cylinder in a manner which varies the volume of said combustion chamber, and the second of said piston means is disposed within said cylinder between said first piston means and said drive means in a varying spaced relationship to said first piston means, said varying spaced relationship defining a compression chamber.

Further, a heat transfer means, which may include a regenerator or alternatively a heat exchanger, is operably connected in a manifold between said compression chamber and said combustion chamber. An intake valve, transfer valves, and an exhaust valve are operably connected to the manifold of said heat transfer means in a manner which enables optimum control of the operation of the engine. Control means are also included for coordinating the various valves with the combustion of the combustion chamber in order to maintain operation of the engine, which operation may utilize air as the working fluid and is capable of drawing the working fluid from an unpressurized and readily available supply, such as the atmosphere.

The engine of the present invention also utilizes many other particularities in a uniquely advantageous combination with the previously mentioned ones. Among those particularities are the incorporation of a rhombic drive, or alternatively a crank, as a means for driving the pistons. Coolant conduits which circumscribe the cylinder and are enlarged about the compression chamber are also provided in order to enhance the functional thermodynamic advantages of the engine. Additionally, the second piston may be provided with a central hole therethrough for enabling connection of said driving means to said first piston. The cylinder may also be composed of different materials in its different parts, the material of the walls of said cylinder proximate said combustion chamber being composed of a nonconductive material relative to material of the walls proximate said compression chamber.

As an alternative, the present invention is also embodied in an open cycle internal combustion Stirling engine which comprises two cylinders with a piston slidably mounted within each of the cylinders. In this alternative embodiment, each of said pistons is operably connected to a means for driving both of said pistons, the first piston and the first of said cylinders forming a compression chamber therebetween, the second piston and the second of said cylinders forming a combustion chamber therebetween, and said first and second cylinders being operably connected by a transfer manifold and a regenerator with an intake means and an exhaust means controlling the flow of the working fluid, and thereby controlling the operation of the engine.

Many other advantages, features and operational details of the present invention will be obvious to one of ordinary skill in the art in light of the foregoing and following descriptions when viewed in conjunction with the accompanying drawings and appended claims.

DESCRIPTION OF THE INVENTION

Figure 1:
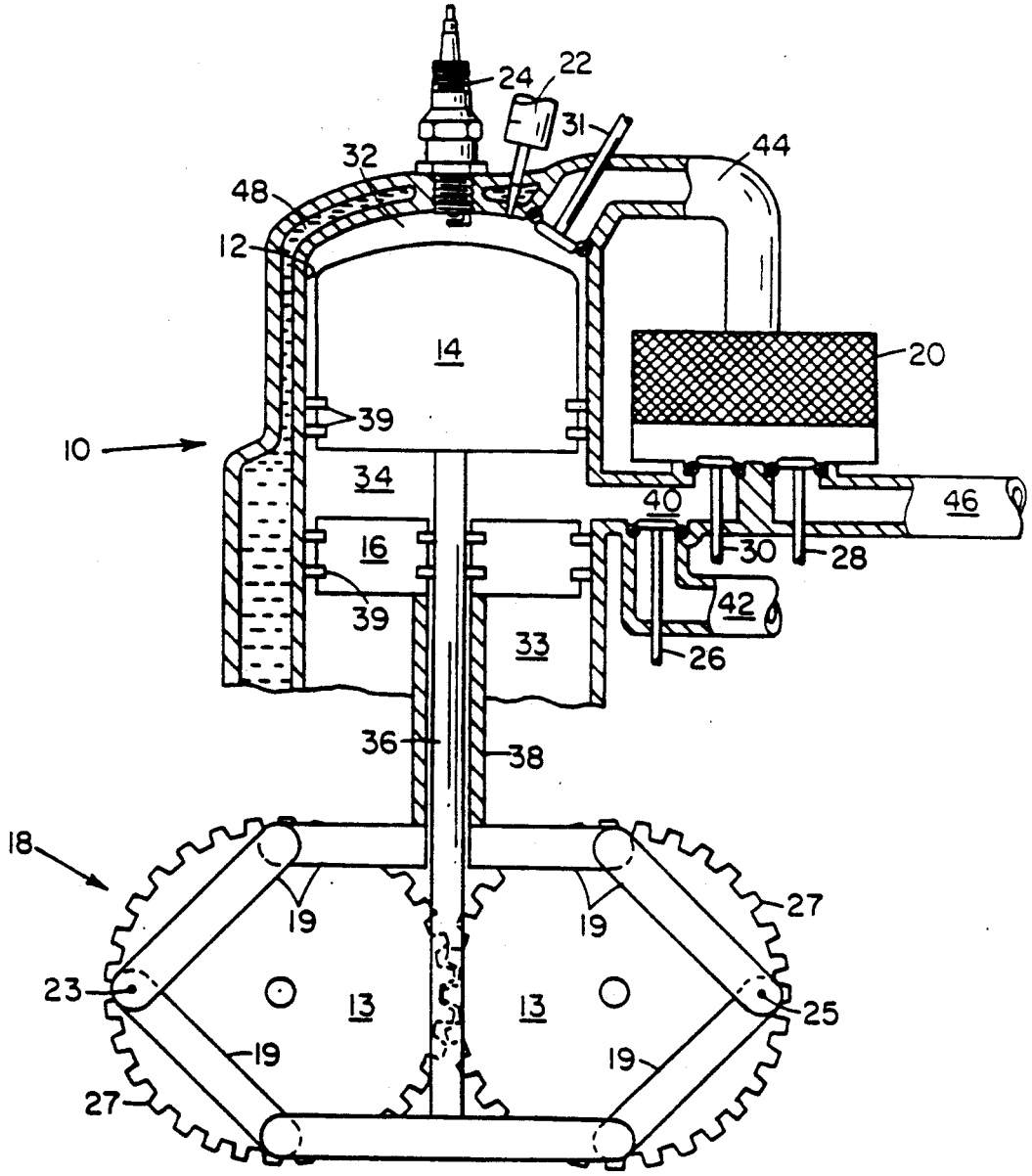
FIG. 1 is a cross-sectional view of the first embodiment of the invention.

The first embodiment of the present invention is engine 10 shown generally in FIG. 1. The engine 10 is comprised basically of a cylinder 12, a "hot" piston 14, a "cold" piston 16, drive connecting means 18, a regenerator 20, an injector means 22, ignition means 24, intake valve 26, exhaust valve 28, and transfer valves 30 and 31.

Hot piston 14 and cold piston 16 are labeled such because the temperatures at which they operate are "hot" and "cold", relative to one another. The pistons are of approximately the same diameter and, therefore, may fit within the same cylinder 12. Hot piston 14 and cold piston 16 define two spaces within the cylinder 12. The first of those spaces is combustion chamber 32, which is located between the hot piston 14 and the ignition means 24. The second of said spaces is compression chamber 34 which is the space between the hot piston 14 and cold piston 16.

Figure 7:
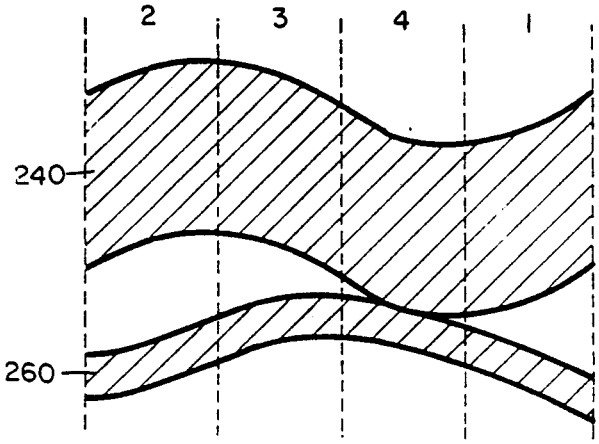
FIG. 7 is a graph of piston displacement in an actual cycle.

The hot piston 14 is connected to the drive connecting means 18 by a piston rod 36. The cold piston 16 is connected by a piston rod sleeve 38 to the drive connecting means 18 (also referred to as "drive means 18"). As is obvious from FIG. 1, piston rod 36, which extends through a central hole in the cold piston 16, reciprocates vertically within and relative to the piston rod sleeve 38. Piston rod sleeve 38, itself, reciprocates vertically within and relative to cylinder 12. This reciprocation of piston rod 36 and of piston rod sleeve 38 is accomplished by drive means 18. Drive means 18 mechanically coordinates the reciprocation of piston 16 with the reciprocation of piston 14 in a manner which enables the operation of engine 10. The relationship between the respective reciprocations of pistons 14 and 16, as coordinated by drive means 18, is evident from the displacement diagram of FIG. 7 (discussed further herein).

Drive means 18 is a rhombic drive that is known in the art; however, other drive means, such as the right angle crank disclosed in Cowans, could be used as alternatives to drive means 18. In the rhombic drive shown in FIG. 1, each of rod 36 and piston rod sleeve 38 are connected by linkage 19 to each of drive gear-wheels 13 and 21 at pivot points 23 and 25, respectively. The teeth 27 of drive wheel 13 mesh with those of drive wheel 21 to ensure rotation of drive wheel 21 at a rate equal to but opposite the rotation rate of drive wheel 13. Each of the central rotational axes of drive wheels 13 and 21 are fixed relative to cylinder 12.

To separate the combustion chamber 32 from the compression chamber 34 and to separate the compression chamber 34 from the lower portion 33 of cylinder 12, a series of rings or seals 39 are provided in annular grooves around hot piston 14 and around cold piston 16. The rings 39 for the hot piston 14 are only around the exterior circumference of the hot piston 14 and are nearer the lower extremity of piston 14 in order to avoid overheating of rings 39. The rings 39 for the cold piston 16, on the other hand, are on both the exterior circumference and the radially inner surface of the cold piston 16, which radially inner surface surrounds the piston rod 36.

Fluid in the compression chamber 34 communicates to the regenerator 20 through a transfer manifold 40, and the combustion chamber 32 communicates with the regenerator 20 through combustion chamber manifold 44. In combination with the pressure differentials created by the reciprocations of pistons 14 and 16 relative to each other and to cylinder 12, valves 26, 28, 30 and 31 control the operative flow of the working fluid in engine 10. Flow of the working fluid through the transfer manifold 40 is controlled by transfer valve 30. Intake manifold 42 supplies the working fluid (i.e. air) to the transfer manifold 40 and to compression chamber 34, and the supply of the working fluid from intake manifold 42 is controlled by intake valve 26. Working fluid is supplied to and from the combustion chamber 32 by a combustion chamber manifold 44, which connects the regenerator 20 with the combustion chamber 32, and such supply is controlled by transfer valve 31. An exhaust manifold 46 is provided to carry gases away from the regenerator 20, and the exhaust is controlled by exhaust valve 28. Each of intake valve 26, exhaust valve 28, and transfer valves 30 and 31 are common engine valves, which are spring-biased in their closed position and are means for selectively enabling flow of the working fluid at their respective locations. Additional means (not shown) which are standard in the art for controlling the operation of valves 26, 28, 30 and 31, such as cam shafts or solenoids, control the operation of engine 10 by coordinating the otherwise independent operations of valves 26, 28, 30 and 31. In an alternative embodiment, however, valves 28 and 31 are controlled by such controlling means as a cam shaft, but valves 26 and 30 are operated only by pressure differentials created by the reciprocations of pistons 14 and 16, said pressure differentials opening the valves 26 and 30 when great enough to overcome the spring-bias of the respective valves.

Referring still to FIG. 1, because the combustion chamber 32 generates much more heat than the compression chamber 34, the cylinder 12 will be subject to differences in temperature between the portion of the cylinder 12 proximate the combustion chamber 32 and that portion of the cylinder 12 around the compression chamber 34. In order to more closely achieve the Stirling thermodynamic cycle and thereby increase efficiency, conduction of heat from the hotter portions of the cylinder 12 to the cooler portions must be minimized and the temperature difference between those portions must be maintained at a maximum. To achieve the largest temperature difference possible, the portion of the cylinder 12 proximate the combustion chamber 32 is cooled only to the extent necessary to prevent overheating, while the lower portion of the cylinder 12 is cooled as much as possible. The present embodiment employs a cooling means 48 using water cooling. Although shown in exaggerated and simplified fashion in FIG. 1, the cooling means 48 is constructed with methods well known in the art to concentrate the flow of the coolant (i.e., the water) in the area of the compression chamber 34. Of course, the cooling means 48 also extends to the right side of the cylinder 12 in FIG. 1, but has been omitted from FIG. 1 for purposes of illustration.

Figure 5:
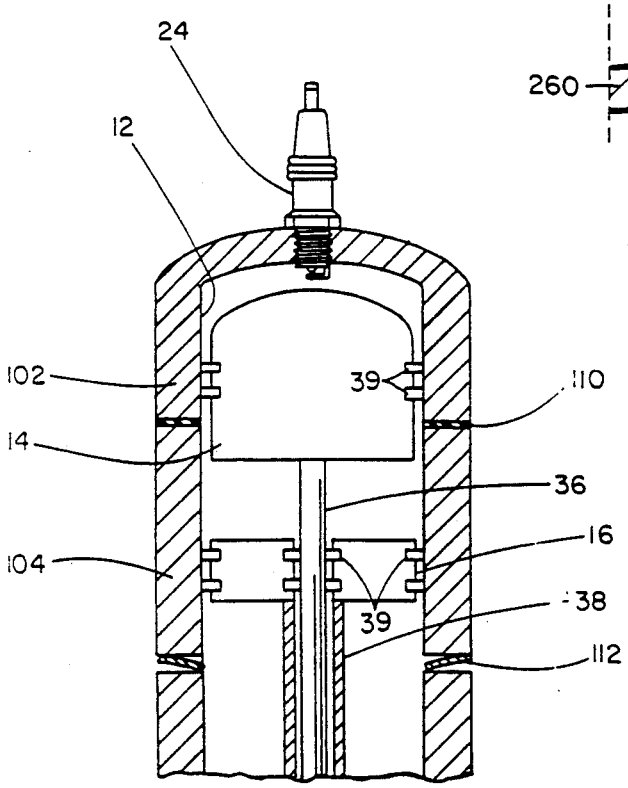
FIG. 5 is a cross sectional view of a first type of cylinder design.

Several other alternative embodiments of the cylinder 12 are also possible to facilitate cooling. As shown in FIG. 5 in a simplified diagram of cylinder 12, the upper portion 102 of the cylinder 12, which portion is hot relative to portion 104, is made entirely of a heat resisting metallic or ceramic material such as are known in the art to prevent conduction from the hot portion 102 to the cold portion 104 of the cylinder 12. The cold portion 104 is comprised of standard conducting metallic materials, such as steel or aluminum. An insulating gasket 110 is inserted between the hot portion 102 and the cold portion 104 to prevent leakage from the cylinder 2 and to prevent cracking of cylinder 12 due to the temperature gradient. At the base of the cold portion 104, Bellville washers 112, shown in FIG. 5 in exaggerated form, are inserted. The ignition means 24 is able to withstand the temperatures encountered in the combustion chamber 32, which temperatures are high relative to those temperatures of normal internal combustion engines. Such spark plugs are commercially available from a variety of manufacturers, such as Champion Spark Plug Co. who manufacture "cold running plugs" designed for operation at elevated combustion temperatures.

The hot piston 14 is of a type well known in the art. The piston is constructed of special high strength alloys designed for high temperature operation, such as nickel-molybendum-iron alloys known in the art. The rings 39 surrounding the hot piston 14 are more heat resistant than are the rings 39 surrounding cold piston 16. As mentioned, an advantage of the open cycle engine over the closed cycle Stirling engine is the lack of extremely high pressures in the engine, making the use of otherwise conventional rings 39 possible.

The regenerator 20 is also of a type known in the art of Stirling engines. Common regenerators and the present invention contain steel balls and steel wool as the heat absorbing/rejecting material. Alternative regenerators use a finely divided or porous ceramic material in the regenerator 20. In addition to acting as a regenerator 20, the porous ceramic is washcoated with a rare metal, such as platinum, to act as a catalyst to oxidize the exhaust as it exits the combustion chamber 32 and aid in the reduction of pollutants.

The injecting means 22 is a common fuel injector such as is known in the art for injecting fuel. Although the injecting means 22 must meet special design considerations because of the high temperatures found in the combustion chamber 32, a number of manufacturers produce fuel injectors for high performance engines which can operate under these temperatures. The injecting means 22 of FIG. 1 is water cooled.

Figure 6:
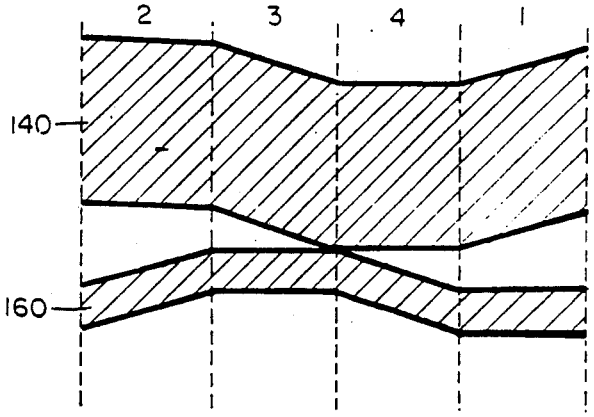
FIG. 6 is a graph of piston displacement in an idealized cycle.

In operation, the embodiment shown in FIG. 1 operates akin to a two cycle Otto engine, in the sense that the ignition means 24 is fired every time the hot piston 14 reaches a certain point close to top dead center. Alternatively, the embodiment of FIG. 1 may be operated with ignition caused by compression within combustion, chamber 32, rather than by ignition means 24. In such case, fuel having a relatively high cetane number would be employed, although engine 10 minimizes the need for high cetane numbers due to high temperatures in combustion chamber 32. Referring to the displacement diagram of FIG. 6, the ideal movements of the hot piston 14 and cold piston 16 are shown dependent on the temporal positions during the complete operative cycle of the embodiment; the temporal positions are segregated in FIG. 6 according to the particular stages of the complete cycle, as indicated 2, 3, 4 and 1. The ideal displacement of the hot piston 14 is shown in the ideal hot displacement chart 140, while the ideal displacement of the cold piston 16 is represented by the ideal cold displacement chart 160. The corresponding actual displacements of pistons 14 and 16 are shown in the actual hot displacement chart 240 and the actual cold displacement chart 260, respectively.

During stage 1, air is drawn into the compression chamber 34 via the intake manifold 42 as the intake valve 26 is opened. The intake of air is facilitated by decreased pressure caused by the upward movement of the hot piston 14, while the cold piston 16 remains relatively stationary. The transfer valve 30 is closed during this stage.

Stage 2 begins as the hot piston 14 reaches approximately top dead center within cylinder 12. At this point, the cold piston 16 begins to move upwardly while the hot piston 14 remains relatively stationary. This compresses the charge of fresh air in the compression chamber 34, as the intake valve 26 is closed and the exhaust valve 28 is closed. The transfer valves 30 and 31 also remain closed. As the cold piston 16 begins to reach top dead center, the transfer valves 30 and 31 open to allow the compressed charge of fresh air in the compression chamber 34 to pass into the regenerator 20, where the air absorbs heat from the regenerator 20, and then passes into the combustion chamber 32 via the combustion chamber manifold 44. Fuel is injected into the charge of air by the fuel injector 22 as the charge of air enters combustion chamber 32.

Stage 3 begins as the transfer valves 30 and 31 are closed and the ignition means 24 ignites the charge. At this point, the hot piston 14 has begun to move downwardly while the cold piston 16 remains relatively stationary. As the hot piston 14 nears the end of its downward motion, the transfer valve 31 and the exhaust valve 28 open to allow the exhaust gases to pass through the regenerator 20 and into the exhaust manifold 46. Regenerator 20 absorbs heat from exhaust gases as they exhaust from combustion chamber manifold 44 through the exhaust valve 28 and into the exhaust manifold 46.

Stage 4 begins as the hot piston 14 reaches bottom dead center and the cold piston 16 begins moving downwardly. Although the transfer valve 30 still remains closed, the intake valve 26 will open to begin the intake of fresh air which is completed in the first stage mentioned above. The transfer valve 31 and exhaust valve 28 are not closed until the end of the next stage 1 in order to allow the upward movement of the hot piston 14 to further facilitate the ejection of exhaust gases from the combustion chamber 32. Thus, although stages 1 and 4 have been described separately in accordance with the conventional delination between intake and exhaust stages, the intake and exhaust of engine 10 occurs simultaneously; for this reason, stage 4 and stage 1 may be referred to conjunctively as the "intex".

The drive means 18 shown in FIG. 1 is a rhombic drive. In describing these stages 1 through 4 above, it was stated that the hot and cold pistons become "relatively stationary" at certain points. However, as is obvious from the design of the rhombic drive, and as dictated by design considerations, either one of the pistons cannot be at a complete standstill while the other piston moves, as would be required in the idealized Stirling cycle. Instead, the piston becomes "relatively still" which means that its rate of motion becomes slower relative to the other piston in the cylinder 12, so that the area of the combustion chamber 32 and compression chamber 34 will either increase or decrease relative to each other. Other drive means are known in the art which could be used instead of a rhombic drive. The actual piston displacement of hot piston 240 and cold piston 260 are shown dependant on the stages of the complete cycle of the embodiment in FIG. 7 in the same fashion as FIG. 6.

Advances in materials, particularly ceramic materials, have made it easier to achieve the very rapid heat absorption and dissipation properties required of the regenerator material in the embodiment of FIG. 1. Further, the regenerator 20 is placed so that the working fluid path length through transfer manifold 40, regenerator 20, and combustion chamber manifold 44 is very short relative to other possibilities. This short path length aids in the maintenance of a relatively pure air intake charge into the combustion chamber 32.

The engine of the present invention offers the following advantages among others:

(1) Since the engine is air breathing, it has a specific output comparable with conventional spark engines and diesel engines.

(2) Due in part to the incorporation of a regenerator, the engine is thermodynamically more efficient than conventional spark engines or diesel engines; and (3) $NO_x$ emissions are low due to high internal exhaust gas recirculation, and hydrocarbon emissions are low due to the regenerator acting as an exhaust thermo-reactor. Of course, emissions could be brought even lower if the regenerator is made of a catalyzed material as in an alternative embodiment.

As previously indicated, the path length of the working fluid outside of the combustion chamber 32 and compression chamber 34 is kept as short as possible. The volume of the air space associated with this path, volume which includes the volumes in regenerator 20, transfer manifold 40 and combustion chamber manifold 44, is known as "dead volume". As an example, for an engine of the embodiment of FIG. 1 having a swept volume of $8\times10^{-4}m^3$ (0.8L), dead volumes of $5.655\times10^{-5}m^3$ for the regenerator 20 and $8.482\times10^{-6}m^3$ for the transfer manifold 40 are achievable. An engine of such specifications is referred to as "the exemplary engine" for reference purposes throughout this detailed description.

An increase in the dead volume of the regenerator 20 must be avoided because of its great effect on power output and thermal efficiency. However, variations in the dead volume of the transfer manifold 40 have less effect on power output or efficiency. It is possible to easily accommodate the needed working fluid in a transfer manifold 40 of the dimensions of the exemplary engine given above. Even with a dead volume in the transfer manifold 40 which is twice as large as in the previously described exemplary engine (i.e. $16.964\times10^{-6}m^3$), the power output is reduced 7 kW and the indicated thermal efficiency decreases only 1-2%.

The effectiveness of the regenerator 20 is a factor which has hindered Stirling engine development. In the traditional closed-cycle Stirling engine, the effectiveness of the regenerator has a large effect on the overall engine output. However, this is less true with an open-cycle Stirling engine because the cycle without a regenerator is somewhat similar to the Otto cycle and therefore has a reasonable efficiency. In an engine 10 with a cylinder bore of 75 mm and a compression ratio of 5 6:1, for instance, varying the regenerator effectiveness from 0 to 100% changes the power output from 63 to 87 kW and the thermal efficiency from 32.5 to 45.1%.

Another factor affecting efficiency and power output of an engine is the phase angle between the two pistons. In conventional Stirling engines, the optimum phase angle between the two chambers (i.e. the compression chamber and the combustion chamber) is approximately 90°. However, although the highest power output of the present engine 10 is reached at a phase angle of approximately 90°, the thermal efficiency of the engine 10 is maximized at approximately 45°. As a compromise between obtaining a maximum power output while retaining a high thermal efficiency, a phase angle of approximately 70° is used in the preferred embodiment of the present invention.

The number of crank degrees required for complete burning of fuel has also been found by Applicant to affect power output and efficiency. Reducing the number of degrees required for burn increases the thermal efficiency due to the higher maximum gas temperature in the cycle and a greater length of time for expansion of the hot gases. Although changes in the burn angle do not have a great effect on the overall efficiency or power output, the optimum burn angle is less than 10° of rotation in the crank. At very small burn angles, a turnover in the efficiency occurs and results in higher heat transfer rates and higher heat losses to the combustion chamber walls.

The opening period (in terms of "crank degrees") of the transfer valves 30 and 31 is made as short as possible, although shorter opening periods present problems with valve accelerations. However, as is known in the art, valve designs used on high revolution engines can reduce the opening period of the transfer valves 30 and 31 to approximately 40 crank degrees. The preferred embodiment of engine 10 incorporates such valve designs to achieve 40 crank degrees for the opening of transfer valves 30 and 31. As an alternative, transfer valve 31 can be eliminated from engine 10 to further simplify the engine 10; operation of such an alternative is the same as previously described if read in ignorance to any referenced to transfer valve 31.

The air to fuel ratio has also been found by Applicant to have a large effect on the performance of the engine 10, particularly on the power output. A lean air to fuel ratio of 80:1 barely overcomes the engine friction. The power output climbs rapidly to over 80 kW for the previously mentioned exemplary engine with an increased air to fuel ratio of 20:1, while thermal efficiency increases from less than 30% to approximately 43% with such an increase in air-fuel ratio. However, varying ratios of specific heats of air and varying conditions of dissociation of gases and heat transfer tend to level out the thermal efficiency and actually reduce it at richer air to fuel ratios.

Figure 3:
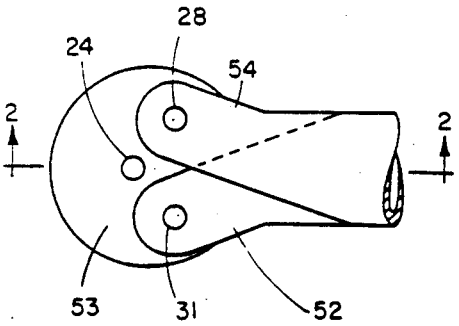
FIG. 3 is a top view of the second embodiment of the invention.
Figure 2:
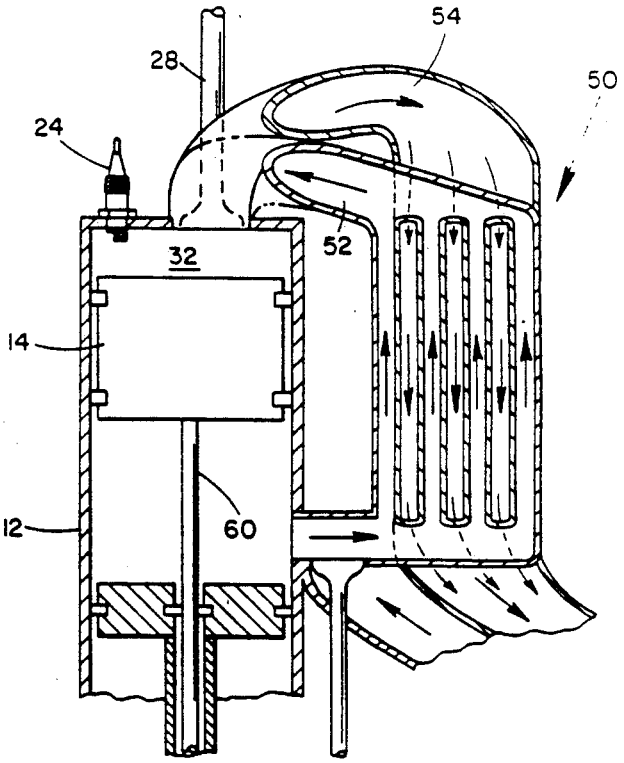
FIG. 2 is a cross-sectional view of the second embodiment of the invention.

Another method of solving the problems associated with regenerator 20 is embodied in the alternative embodiment shown in FIGS. 2 and 3, in which heat exchanger 50 is substituted for the regenerator 20 of FIG. 1. In this alternative shown in FIGS. 2 and 3, the intake and exhaust gases are separated by providing separate intake and exhaust manifolds, 52 and 54, respectively, for carrying gases to and from the combustion chamber 32. These separated manifolds are shown more clearly in FIG. 3. The operation of the engine shown in FIG. 2 is similar to that of FIG. 1, except that the use of the heat exchanger 50 in place of the regenerator 20 allows the exhaust valve 28 to be located on the cylinder head 53, and the transfer valve 30 to be omitted.

Figure 4:
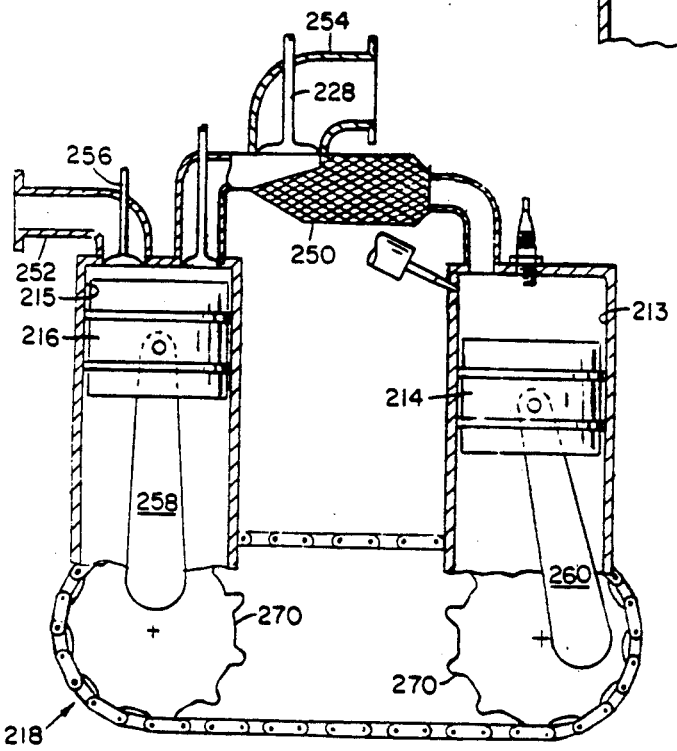
FIG. 4 is a cross-sectional view of the third embodiment of the invention.

A third embodiment of the present invention is shown in FIG. 4. That embodiment likewise employs a regenerator 250, but the intake and exhaust of gases are altered from those of the embodiment shown in FIG. 1. The hot piston 214 and cold piston 216 of FIG. 4 are placed in separate cylinders, those cylinders being a hot cylinder 213 and a cold cylinder 215. This design shares features of the design of FIG. 2, in that a separate intake valve 256 and exhaust valve 228 are provided with separate intake and exhaust manifolds, 252 and 254, respectively. Compression occurs in the compression chamber 234 in the same sequence as the embodiment shown in FIG. 1 and FIG. 2, except that it is necessary to time the operation of the cold piston rod 258 with the hot piston rod 260. A chain drive 218, which is known in the art, mechanically couples the respective reciprocations of pistons 214 and 216. The chain drive 218 is comprised of two gear wheels 270 about which the cold piston rod 258 and hot piston rod 260 pivot, said gear wheels 270 being linked by a chain.

Although the invention has been described in conjunction with the foregoing specific embodiments, many other alternatives, variations and modifications will be apparent to those of ordinary skill in the art. These alternatives, variations and modifications are intended to fall within the spirit and scope of the appended claims.

I claim:

1. An internal-combustion fluid engine comprising:

means, including a hot piston, for defining a combustion chamber;

means for causing combustion within said combustion chamber;

means, including a cold piston, for defining a compression chamber for pressurizing a fluid;

inlet control means for controlling flow of the fluid into said compression chamber;

cooling means for maintaining lower temperature in said compression chamber than in said combustion chamber;

means, comprising linkage between said hot piston and said cold piston, for varying the volume of said compression chamber in relation to the volume of said combustion chamber in a manner characteristic of a conventional Stirling engine;

a manifold connected in fluid communication between said combustion chamber and said compression chamber for enabling flow of the fluid from said compression chamber to said combustion chamber;

transfer control means for controlling the flow of the fluid from said compression chamber to said combustion chamber;

heat transfer means connected to said manifold for transferring heat from gases exhausted from said combustion chamber to the fluid flowing from said compression chamber to said combustion chamber; and exhaust control means for controlling the exhaust of gases from said combustion chamber.

2. The internal-combustion fluid engine of claim 1 wherein:

said manifold has a first port in communication with said compression chamber for enabling the flow of the fluid from said compression chamber to said combustion chamber; and said inlet control means enables the flow of the fluid to said compression chamber through said first port.

3. The internal-combustion fluid engine of claim 2 wherein:

said manifold has a second port in communication with said combustion chamber for enabling the flow of the fluid from said compression chamber to said combustion chamber; and said exhaust control means enables the exhaust of gasses from said combustion chamber through said second port.

4. The internal-combustion fluid engine of claim 1 wherein:

said manifold has an inlet in direct communication with a low pressure air supply; and said inlet control means is operatively disposed within said inlet.

5. The internal-combustion fluid engine of claim 1, wherein said heat transfer means comprises a regenerator.

6. The internal-combustion fluid engine of claim 1 wherein said heat transfer means comprises a heat exchanger for transferring heat between gasses exhausting from said combustion chamber and fluid being directed to said combustion chamber.

7. The internal-combustion fluid engine of claim 1, wherein:

said volume varying means comprises a rhombic drive; and said cold piston is provided with an opening therethrough for enabling connection of said rhombic drive with said hot piston.

8. The internal-combustion fluid engine of claim 5 wherein said volume means comprises a crank.

9. The internal-combustion fluid engine of claims 5 or 6, wherein said compression chamber has an inlet in fluid communication with an unpressurized source of fluid.

10. The internal-combustion fluid engine of claim 5, wherein said cooling means comprises coolant conduits proximate said cylinder, portions of said cooling conduits proximate the compression chamber being more substantial than portions of said cooling conduit proximate said combustion chamber.

11. An open-cycle internal-combustion fluid engine comprising:

a cylinder forming a combustion chamber at one end thereof;

a hot piston slidably mounted within said cylinder so as to vary the volume of said combustion chamber;

a cold piston slidably mounted within said cylinder in a varying spaced relationship with said first piston, said varying spaced relationship defining a compression chamber;

means, comprising linkage between said hot piston and said cold piston, for mechanically relating reciprocation of said hot piston with reciprocation of said cold piston to vary the volume of said compression chamber in relation to the volume of said combustion chamber in a manner characteristic of a conventional Stirling engine, said relating means being operatively connected between said hot piston and said cold piston;

cooling means for maintaining lower temperatures in said compression chamber than in said combustion chamber;

means for enabling communication of fluid between said compression chamber and said combustion chamber;

heat transfer means integral with said communication-enabling means for transferring heat to fluid being directed to said combustion chamber;

intake means operably connected to said compression chamber for supplying fluid to said compression chamber; and exhaust means operably connected to said combustion chamber for enabling exhaust of gasses therefrom.

12. The internal-combustion fluid engine of claim 11, wherein the material of the walls of said cylinder proximate said combustion chamber is comprised of a non-conductive material relative to the material of the walls of said cylinder prosimate said compression chamber.

13. The internal-combustion fluid engine of claim 11 further comprising control means for controlling the flow of fluid between said intake means and said exhaust means.

14. The internal-combustion fluid engine of claim 13, wherein said control means comprises a plurality of valves.

15. An internal-combustion fluid engine, comprising:

means, including a cold piston, for defining a compression chamber within a block, said compression chamber having an inlet in fluid communication with an air supply;

means, including a hot piston, for defining a combustion chamber;

a transfer manifold mounted to said block, said manifold having at least one passage therein, for enabling the flow of air from said compression chamber to said combustion chamber;

cooling means for maintaining lower temperatures in said compression chamber than in said combustion chamber;

means for mixing a fuel with the air such that a combustible mixture of the air and the fuel is provided in said combustion chamber;

means for causing combustion of said combustible mixture within said combustion chamber;

said combustion chamber having an exhaust port for exhausting exhaust gases from said combustion chamber after combustion of said combustible mixture;

heat transfer means connected to said manifold for transferring heat from the exhaust gases to the air flowing from said compression chamber to said combustion chamber;

said manifold being constructed to direct the exhaust gases from said combustion chamber through said heat transfer means and to an exhaust manifold;

control means for controlling the operation of a plurality of valves in a manner such that air from said air supply flows to said compression chamber and the exhaust gases flow from said combustion chamber in an open-cycle fashion; and means, comprising linkage between said hot piston and said cold piston, for varying the volume of said compression chamber in relation to the volume of said combustion chamber in a manner characteristic of a conventional Stirling engine.

16. An internal-combustion fluid engine, comprising:

means, including a cold piston, for defining a compression chamber having an inlet, said inlet being in direct communication with an unpressurized air supply;

means, including a hot piston, for defining a combustion chamber;

a manifold connected in fluid communication between said compression chamber and said combustion chamber for enabling the flow of air from said compression chamber to said combustion chamber;

heat transfer means connected to said manifold for transferring heat from gases exhaust from said combustion chamber to the air flowing from said compression chamber to said combustion chamber;

cooling means for maintaining lower temperatures in said compression chamber than in said combustion chamber;

means for mixing a fuel with the air such that a combustible mixture of the air and the fuel is provided in said combustion chamber;

means for causing combustion of said combustible mixture within said combustion chamber;

said combustion chamber having an exhaust port for exhausting the mixture from said combustion chamber after combustion; and linkage between said hot piston and said cold piston for coordinating said hot piston with said cold piston to vary the volume of said compression chamber in relation to the volume of said combustion chamber in a manner characteristic of a conventional Stirling engine.

17. An internal-combustion fluid engine, comprising:

a cold piston defining a compression chamber within a block, said compression chamber having an inlet in direct communication with a low pressure air supply;

a hot piston defining a combustion chamber within a block;

a manifold connected in fluid communication between said compression chamber and said combustion chamber for enabling communication of air from said compression chamber to said combustion chamber;

heat transfer means connected to said manifold for transferring heat from gases exhausted from said combustion chamber to the air flowing from said compression chamber to said combustion chamber;

a fuel inlet for mixing a fuel with the air such that a combustible mixture of the air and the fuel is provided in said combustion chamber;

means for causing combustion of said combustible mixture within said combustion chamber;

said combustion chamber having an exhaust port for exhausting the mixture from said combustion chamber after combustion thereof;

cooling means for maintaining lower temperatures in said compression chamber than in said combustion chamber, said cooling means comprising coolant conduits for cooling said engine, portions of said cooling conduits proximate the compression chamber being more substantial than portions of said coolant conduits proximate said combustion chamber;

linkage between said hot piston and said cold piston for coordinating said cold piston with said hot piston to vary the volume of said compression chamber in relation to the volume of said combustion chamber in a manner characteristic of a conventional Stirling engine; and control valves for controlling the operation of said engine in accordance with a Stirling cycle.

18. The internal-combustion fluid engine of claim 17, wherein said control valves comprise:

a transfer valve for controlling the flow of air from said compression chamber to said combustion chamber;

an exhaust valve for controlling the exhaust of gases from said combustion chamber; and an inlet valve positioned in said inlet for controlling the provision of low pressure air to said compression chamber.

19. An internal-combustion fluid engine, comprising:

a cold piston defining a compression chamber within a block said compression chamber having an inlet in direct communication with a low pressure air supply;

an inlet valve positioned in said inlet;

a hot piston defining a combustion chamber within said block, said combustion chamber having an exhaust port;

a transfer manifold connected in fluid communication between said compression chamber and the exhaust port of said combustion chamber;

a regenerator mounted in said transfer manifold for transferring heat from gases exhausted from said combustion chamber to air directed from said compression chamber to said combustion chamber;

an exhaust manifold connected to said transfer manifold in an orientation such that exhaust gases from said exhaust port pass through said regenerator in route to said exhaust manifold;

a first transfer valve positioned in said transfer manifold between said compression chamber and said regenerator;

a second transfer valve positioned in said transfer manifold between said regenerator and said exhaust port;

an exhaust valve positioned in said transfer manifold between said regenerator and said exhaust manifold; and a fuel inlet for mixing a fuel with the air such that a combustible mixture of the air and the fuel is provided in said combustion chamber;

a spark plug for causing combustion of said combustible mixture within said combustion chamber;

cooling means for maintaining lower temperatures in said compression chamber than in said combustion chamber, said cooling means comprising coolant conduits formed in said block for cooling said engine, portions of said coolant conduits proximate the compression chamber being more substantial than portions of said coolant conduits proximate said combustion chamber; and a rhombic drive operatively linking said cold piston with said hot piston for varying the volume of said compression chamber in relation to the volume of said combustion chamber in a manner characteristic of a conventional Stirling engine.

* * * * *